US010837247B2

(12) United States Patent
Qin et al.

(10) Patent No.: US 10,837,247 B2
(45) Date of Patent: Nov. 17, 2020

(54) NATURAL GAS HYDRATE PRESSURE-RETAINING CORER

(71) Applicant: Guangzhou Marine Geological Survey, Guangzhou (CN)

(72) Inventors: Xuwen Qin, Guangzhou (CN); Qiuping Lu, Guangzhou (CN); Jianliang Ye, Guangzhou (CN); Haijun Qiu, Guangzhou (CN); Jingan Lu, Guangzhou (CN); Beibei Kou, Guangzhou (CN); Yanjiang Yu, Guangzhou (CN); Fangfei Huang, Guangzhou (CN); Zenggui Kuang, Guangzhou (CN); Zhigang Zhang, Guangzhou (CN); Jiangong Wei, Guangzhou (CN)

(73) Assignee: Guangzhou Marine Geological Survey, Guangzhou (CN)

( * ) Notice: Subject to any disclaimer, the term of this patent is extended or adjusted under 35 U.S.C. 154(b) by 0 days.

(21) Appl. No.: 16/426,276

(22) Filed: May 30, 2019

(65) Prior Publication Data

US 2019/0368294 A1 Dec. 5, 2019

(30) Foreign Application Priority Data

May 30, 2018 (CN) ..... 2018 1 0535067

(51) Int. Cl.

| | |
|---|---|
| ***E21B 25/08*** | (2006.01) |
| ***E21B 34/06*** | (2006.01) |
| ***E21B 25/18*** | (2006.01) |

(52) U.S. Cl.

CPC ..... *E21B 25/08* (2013.01); *E21B 25/18* (2013.01); *E21B 34/06* (2013.01); *E21B 2200/04* (2020.05)

(58) Field of Classification Search

CPC .... E21B 25/08; E21B 25/18; E21B 2034/002; E21B 34/06; E21B 2043/0115; E21B 33/035; E21B 25/10

See application file for complete search history.

(56) References Cited

U.S. PATENT DOCUMENTS

| | | | | |
|---|---|---|---|---|
| 3,064,742 A * | 11/1962 | Bridwell | ..... | E21B 25/08 175/226 |
| 6,659,204 B2 * | 12/2003 | Aumann | ..... | E21B 25/08 175/17 |
| 7,600,580 B2 * | 10/2009 | Cravatte | ..... | E21B 25/08 166/264 |

FOREIGN PATENT DOCUMENTS

| | | |
|---|---|---|
| CN | 102866037 A | 1/2013 |
| CN | 107727432 A | 2/2018 |

* cited by examiner

*Primary Examiner* — Tara Schimpf
*Assistant Examiner* — Jonathan Malikasim
(74) *Attorney, Agent, or Firm* — Muncy, Geissler, Olds & Lowe, P.C.

(57) ABSTRACT

A natural gas hydrate pressure-retaining corer includes an outer tube assembly and an inner tube assembly installed inside the outer tube assembly. The inner tube assembly includes a first inner tube assembly and a second inner tube assembly. The first inner tube assembly includes a spearhead, a latching device, a suspension plug, a hydraulic piston tube, a piston short limit short section, a limit copper pin, a sealing head, a middle tube, a weight tube drive mechanism and a pressure-retaining ball valve closing sealing mechanism which are sequentially connected from top to bottom. The second inner tube assembly includes a piston compensation balance mechanism, a single-action mechanism, an accumulator mechanism, a sealing mechanism and a core barrel connected sequentially from top to bottom.

10 Claims, 17 Drawing Sheets

NATURAL GAS HYDRATE PRESSURE-RETAINING CORER

CROSS-REFERENCE TO RELATED APPLICATIONS

This application claims the benefit of Chinese Patent Application No. 201810535067.3, filed on May 30, 2018 in the National Intellectual Property Administration Of China, the disclosure of which is incorporated herein by reference in its entirety.

TECHNICAL FIELD

The present invention relates to the field of drilling technology, and in particular to a natural gas hydrate pressure-retaining corer.

BACKGROUND

Natural gas hydrate is a resource-rich and efficient clean energy source. It is the strategic high point of global energy development in the future. Natural gas hydrates are found in sediments below the seabed of the deep sea continental slope or buried in the polar areas. In such an environment, it is difficult to collect natural gas hydrate samples, which is not only due to the fact that natural gas hydrates are located in harsh and inaccessible polar or deep-sea marine environments, but also due to the fact that when it is brought to the surface, natural gas hydrates decompose rapidly due to high pressure and temperature changes, which results in failure of the coring. Natural gas hydrates are stable only under appropriate high pressure and low temperature conditions, but rely more on the high pressure environment to maintain the state of natural gas hydrate. Ordinary corer generally does not have airtightness and cannot retain pressure. The coring effect of such a corer is not ideal. Therefore, providing a corer with good pressure retaining effect is an urgent problem to be solved in the field.

SUMMARY

In view of the deficiencies of the prior art, the embodiment of the present invention provides a natural gas hydrate pressure-retaining corer, which can achieve pressure-retaining and core-taking, and improve the coring success rate.

The technical solution of the embodiment is: a natural gas hydrate pressure-retaining corer, comprising: an outer tube assembly and an inner tube assembly mounted inside the outer tube assembly, the inner wall of the outer tube assembly being provided with a landing ring and a latch chamber, and a coring bit being provided at the bottom end of the outer tube assembly, wherein the inner tube assembly includes a first inner tube assembly and a second inner tube assembly, the second inner tube assembly is mounted inside the first inner tube assembly and is axially movable along the first inner tube assembly, the first inner tube assembly includes a spearhead, a latching device, a suspension plug, a hydraulic piston cylinder, a piston lower limit short section, a limit copper pin, a sealing head, a middle tube, a weight tube drive mechanism and a pressure-retaining ball valve closing sealing mechanism connected sequentially from top to bottom; and the second inner tube assembly comprises a piston compensation balance mechanism, a single-action mechanism, an accumulator mechanism, a sealing mechanism and a core barrel connected sequentially from top to bottom; the piston compensation balance mechanism includes a piston sliding tube, a piston body and a hydraulic piston rod; the suspension plug includes a suspension plug inlet and a suspension plug outlet disposed on opposite sides of the suspension plug, and the suspension plug inlet and the suspension plug outlet communicate with each other; the upper portion of the piston sliding tube is disposed inside the latching device and is axially movable along the latching device, and the lower portion is disposed inside the hydraulic piston cylinder; the piston body is disposed inside the hydraulic piston cylinder and is axially movable relative to the hydraulic piston cylinder, the piston body includes a piston body inlet passage and a piston body separation passage; the lower end of the piston body is connected to the upper end of the hydraulic piston rod located inside the hydraulic piston cylinder, the upper end of the piston body is connected to the lower end of the piston sliding tube; the bottom end of the hydraulic piston cylinder is connected to the upper end of piston lower limit short section, the lower portion of the hydraulic piston cylinder is provided with the hydraulic piston cylinder outlet, and the hydraulic piston cylinder outlet and the piston body separation passage communicate with each other; and a suspension ring is arranged at the connection between the hydraulic piston cylinder and the latching device, and the suspension ring is seated on the landing ring; the piston lower limit short section is provided with a limit copper pin, and the limit copper pin, and is fixedly disposed on the piston lower limit short section after passing through a hydraulic piston rod long pin hole on the hydraulic piston rod and the piston lower limit short section; the single-action mechanism is located inside the piston lower limit short section, and is connected to a connecting tube underneath, the lower end of the piston lower limit short section is connected to the upper end of the sealing head, and the lower end of the sealing head is connected to the upper end of the middle tube located inside the outer tube; the sealing mechanism is located inside the middle tube and is axially movable along the middle tube; the core barrel is located inside the middle tube, and the core barrel is provided with a core barrel shoulder; the weight tube drive mechanism comprises a shear short section, a shear pin, a counterweight tube upper limit shoulder, a counterweight tube lower limit shoulder, a counterweight tube and a thrust thin-walled tube, the shear short section is located between the middle tube and the core barrel, the shear short section is seated on the counterweight tube upper limit shoulder on the inner wall of the middle tube, the shear short section is clearance-fitted with the middle tube and the shear short section is clearance-fitted with the core barrel, and are in a vertical state; the shear pin passes through the shear short section and the counterweight tube, so that the shear short section is connected to the counterweight tube, the upper end of the counterweight tube is in contact with the shear short section, the lower end of the counterweight tube is fixedly connected to the thrust thin-walled tube, and the counterweight tube is in contact with the counterweight tube lower limit shoulder on the middle tube, and the counterweight tube is held by the counterweight tube lower limit shoulder; the pressure-retaining ball valve closing sealing mechanism comprises a ball valve sub, a ball valve sub upper gland, an upper ball valve seat, a ball valve, a lower ball valve seat and a ball valve sub lower gland; the ball valve sub is provided with a ball valve closing drive pin and a ball valve sub oblong hole and a ball valve sub window disposed inside the hollow portion of the ball valve sub sequentially from top to bottom; the ball valve is provided with a ball valve shaft and a ball valve closing sliding groove, and the ball valve is provided with a through hole for the core barrel to pass through; the upper end of the ball valve sub is connected to the lower end of the middle tube, the middle portion of the ball valve sub is provided with the ball valve sub oblong hole, the ball valve closing drive pin located in the ball valve sub oblong hole is fixed on the inner wall of the ball valve sub, and the ball valve closing drive pin protrudes into the ball valve closing sliding slot on the ball valve; the ball valve is fixedly disposed in the ball valve sub window of the ball valve sub through the ball valve shaft, the ball valve shaft is connected to the ball valve at one end, and the other end protrudes into the ball valve sub oblong hole, and is axially slidable freely in the ball valve sub oblong hole; the interior of the ball valve sub is provided with the upper ball valve seat and the lower ball valve seat, the upper ball valve seat is connected to the ball valve sub upper gland, the upper end of the ball valve sub upper gland is connected to the lower end of the thrust thin-walled tube, the lower end of the upper ball valve seat is in contact with the ball valve, the lower ball valve seat is connected to the ball valve sub lower gland, and the upper end of the lower ball valve seat is in contact with the ball valve; the lower end of the pressure-retaining ball valve closing sealing mechanism is connected to a flushing mechanism for flushing the core barrel; and the pressure-retaining ball valve closing sealing mechanism is connected to the weight tube drive mechanism and the middle tube, and the weight tube drive mechanism can push the ball valve of the pressure-retaining ball valve closing sealing mechanism to flip by 90°.

Furthermore, the single-action mechanism comprises an upper thrust bearing, a mandrel, a copper sleeve, a bearing sleeve, a lower thrust bearing and a lock nut, the upper end of mandrel is screwed to the bottom end of the hydraulic piston rod, the bearing sleeve is sleeved on the mandrel, the copper sleeve is arranged between the bearing sleeve and the mandrel, the upper and lower ends of the copper sleeve are respectively provided with the upper thrust bearing and the lower thrust bearing, the bottom end of the mandrel is provided with the lock nut, and the lower thrust bearing is located above the lock nut.

Furthermore, the piston body further comprises a spring chamber, the spring chamber has a sliding valve and a spring base respectively on the upper and lower ends, the spring base is fixedly disposed at the lower portion of the piston body, a spring is disposed inside the spring chamber, the spring is mounted on the spring base, and the upper end of the spring is connected to the lower end of the sliding valve.

Furthermore, the inner tube assembly is provided with an accumulator mechanism, and the accumulator mechanism is located between the single-action mechanism and the sealing mechanism and connected to the single-action mechanism and the sealing mechanism respectively; the accumulator mechanism comprises an accumulator valve cover, an accumulator chamber, a piston, and an accumulator lower end cap, an accumulator pressure joint, a high pressure hose and a high pressure chamber pressure measuring joint arranged sequentially from top to bottom, the piston is located inside the accumulator chamber and is axially movable along the accumulator chamber, a sealing ring is arranged at the junction of the piston and the accumulator chamber, the piston is in contact with the accumulator lower end cover, an axial through hole is arranged in the middle portion of the accumulator lower end cover, the accumulator pressure joint is connected to the high pressure chamber pressure measuring joint through the high pressure hose, the axial through hole, the accumulator pressure joint, the high pressure hose and the high pressure chamber pressure measuring joint communicate with each other to form an air passage, and the accumulator mechanism is located inside the connecting tube.

Furthermore, the sealing mechanism comprises a sealing joint, a pressure passage, a sealing joint sealing ring and a sealing joint step, the upper end of the sealing joint is connected to the lower end of the connecting tube and is connected to the accumulator mechanism, the middle portion of the sealing joint is provided with the axial pressure passage, the lower end of the high pressure chamber pressure measuring joint protrudes into the pressure passage and communicates with the pressure passage, the sealing joint is sleeved with the sealing joint sealing ring, and the sealing joint is provided with sealing joint steps on each side.

Furthermore, the attachment between the ball valve sub and the upper ball valve seat is provided with an upper ball valve seat sealing ring, the attachment between the ball valve sub and the lower ball valve seat is provided with a lower ball valve seat sealing ring; the upper ball valve seat is provided with a buffer spring, the upper and lower ends of the buffer spring are respectively connected to the ball valve upper gland and the upper ball valve seat, the upper end of the ball valve sub upper gland is connected to the lower end of the thrust thin-walled tube, the lower end of the upper ball valve seat is in contact with the ball valve; the lower ball valve seat is provided with a load-bearing spring, the upper and lower ends of the load-bearing spring are respectively connected to the lower ball valve seat and the ball valve sub lower gland, and the upper end of the lower ball valve seat is in contact with the ball valve.

Furthermore, the counterweight tube lower limit shoulder is located below the counterweight tube upper limit shoulder, the counterweight tube is located between the middle tube and the core barrel, the outer wall of the counterweight tube is clearance fitted with the inner wall of the middle tube, a clearance is provided between the counterweight tube and the core barrel, a clearance is provided between the thrust thin-walled tube and the middle tube and between the thrust thin-walled tube and the core barrel, the core barrel shoulder is located between the counterweight tube and the core barrel and is located below the shear short section, and the shear short section is suspended between the middle tube and the core barrel through the counterweight tube upper limit shoulder, so that the counterweight tube and the thrust thin-walled tube connected to the shear short section are also suspended between the middle tube and the core barrel.

The beneficial effects of the present invention are as follows. In the specific use, after the core barrel is pulled upward from the through hole of the ball valve, the counterweight tube of the weight tube drive mechanism slides downward under the action of gravity, pushing the ball valve as a whole to move downward along the ball valve sub. When the ball valve shaft connected to the ball valve is in contact with the ball valve closing drive pin, the thrust generated by the downward movement of the counterweight tube pushes the ball valve closing drive pin. Since the ball valve closing drive pin is held by the ball valve closing sliding groove on the ball valve, the ball valve closing drive pin gives a torque to the ball valve, so that the ball valve is flipped clockwise upward by 90°. The ball valve is in sealing contact with the upper ball valve seat, thereby realizing the pressure-retaining effect of the upper portion of the ball valve. At this time, the core barrel is located in the pressure-retaining area above the ball valve, so that the coring sample in the core barrel is in a pressure retaining state, realizing the pressure-retaining sampling of the corer and preventing decomposition of the coring sample.

BRIEF DESCRIPTION OF THE DRAWINGS

FIGS. 2 to 4 are schematic diagrams showing the segment structure of FIG. 1, the lower end of FIG. 2 is connected to the upper end of FIG. 3, and the lower end of FIG. 3 is connected to the upper end of FIG. 4.

Figure 1:
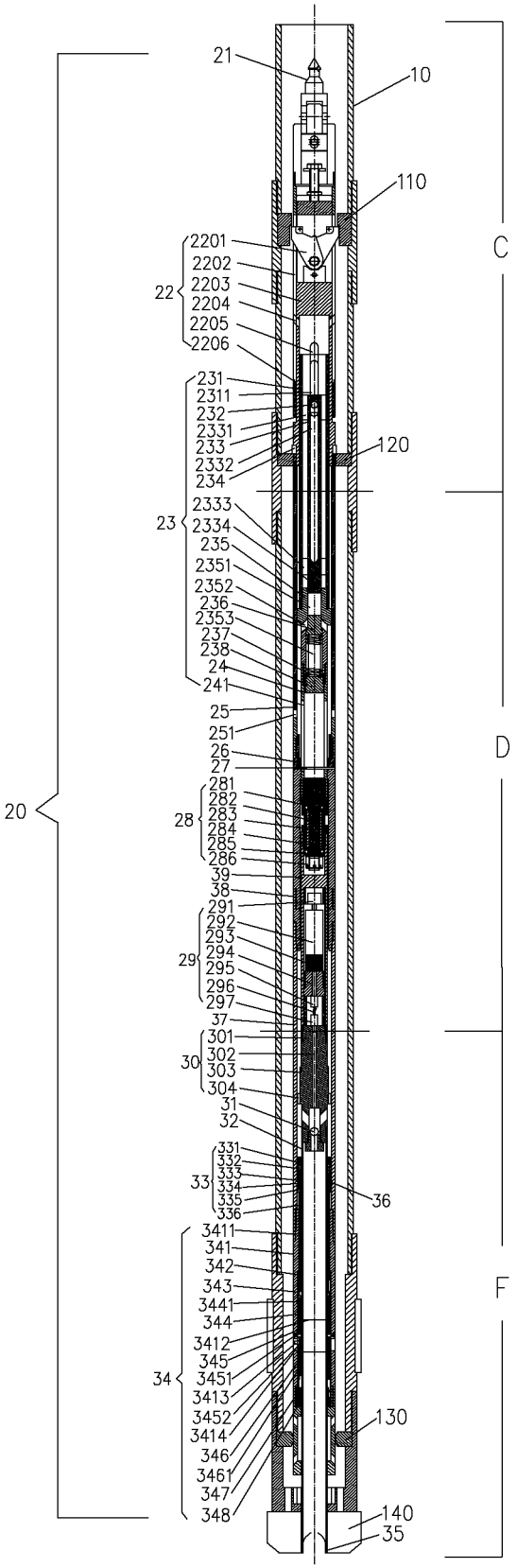
FIG. 1 is a schematic view of the overall structure of the present invention.
Figure 2:
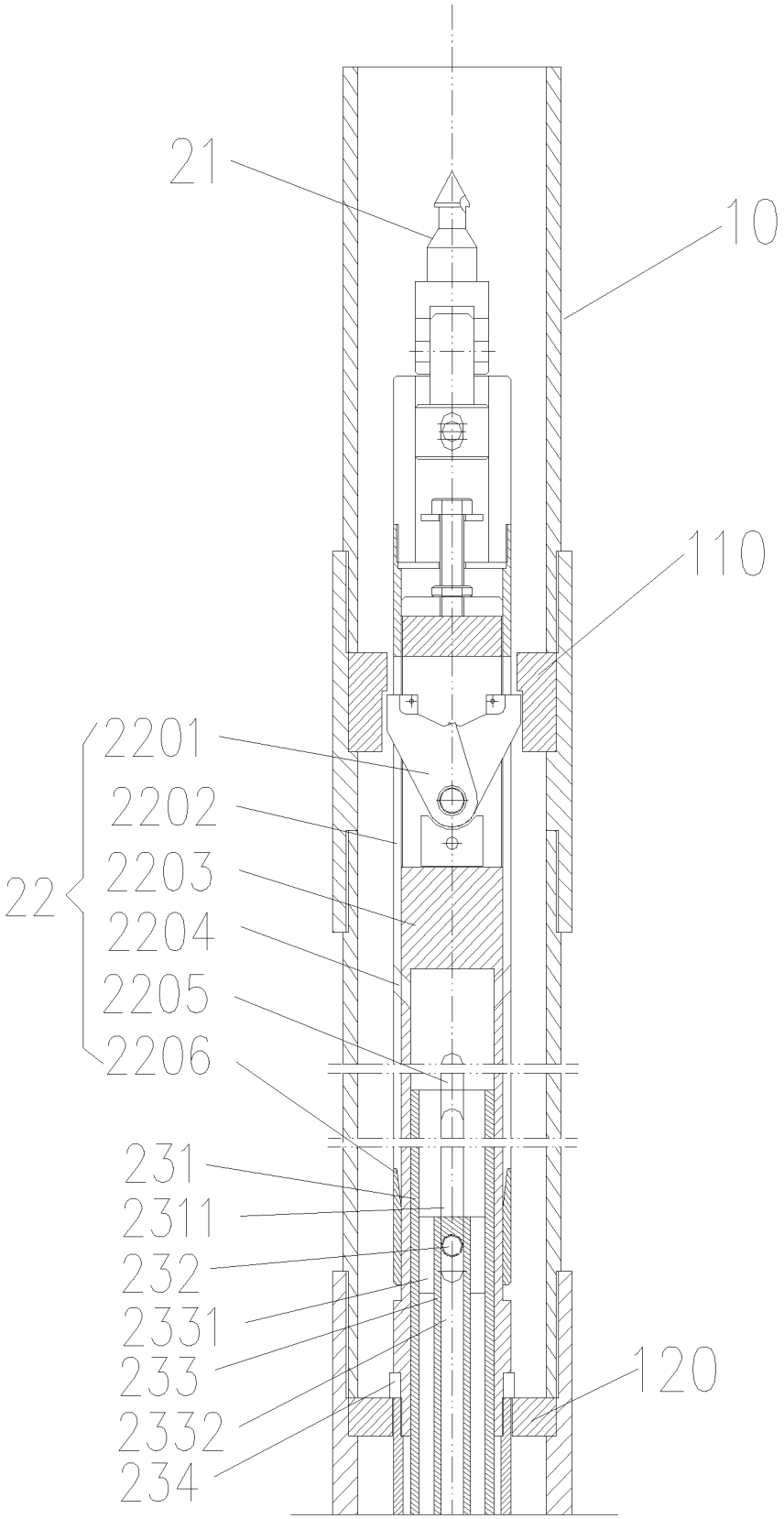
FIG. 2 is an enlarged schematic view of a segment C of FIG. 1.
Figure 3:
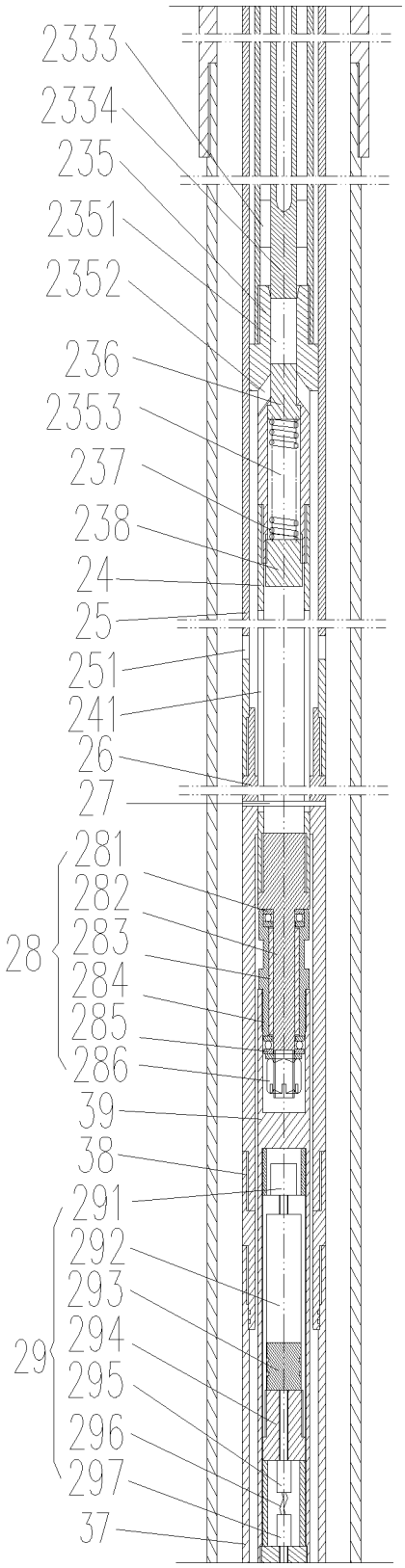
FIG. 3 is an enlarged schematic view of a segment D of FIG. 1.
Figure 4:
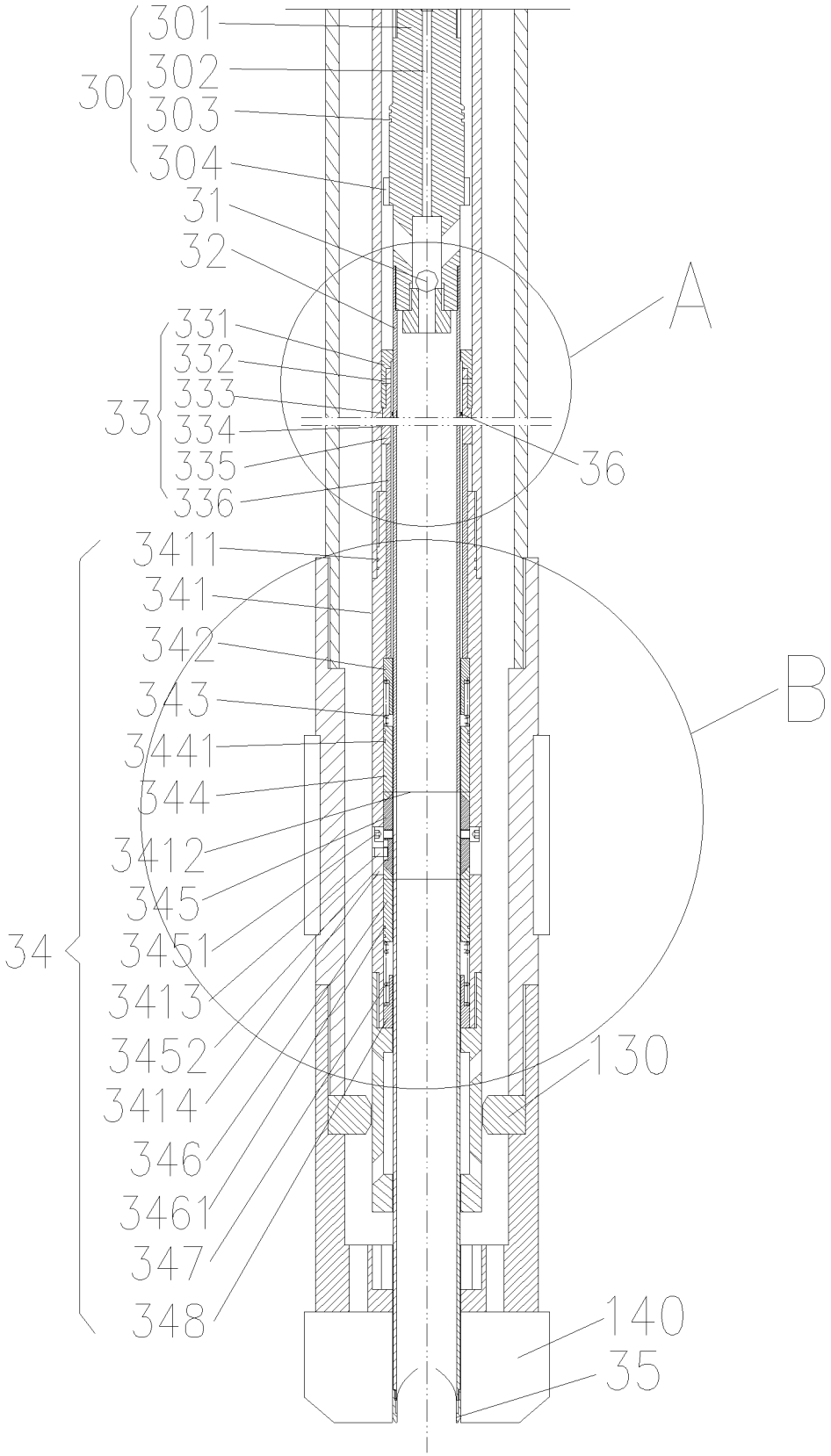
FIG. 4 is an enlarged schematic view of an F segment of FIG. 1.
Figure 5:
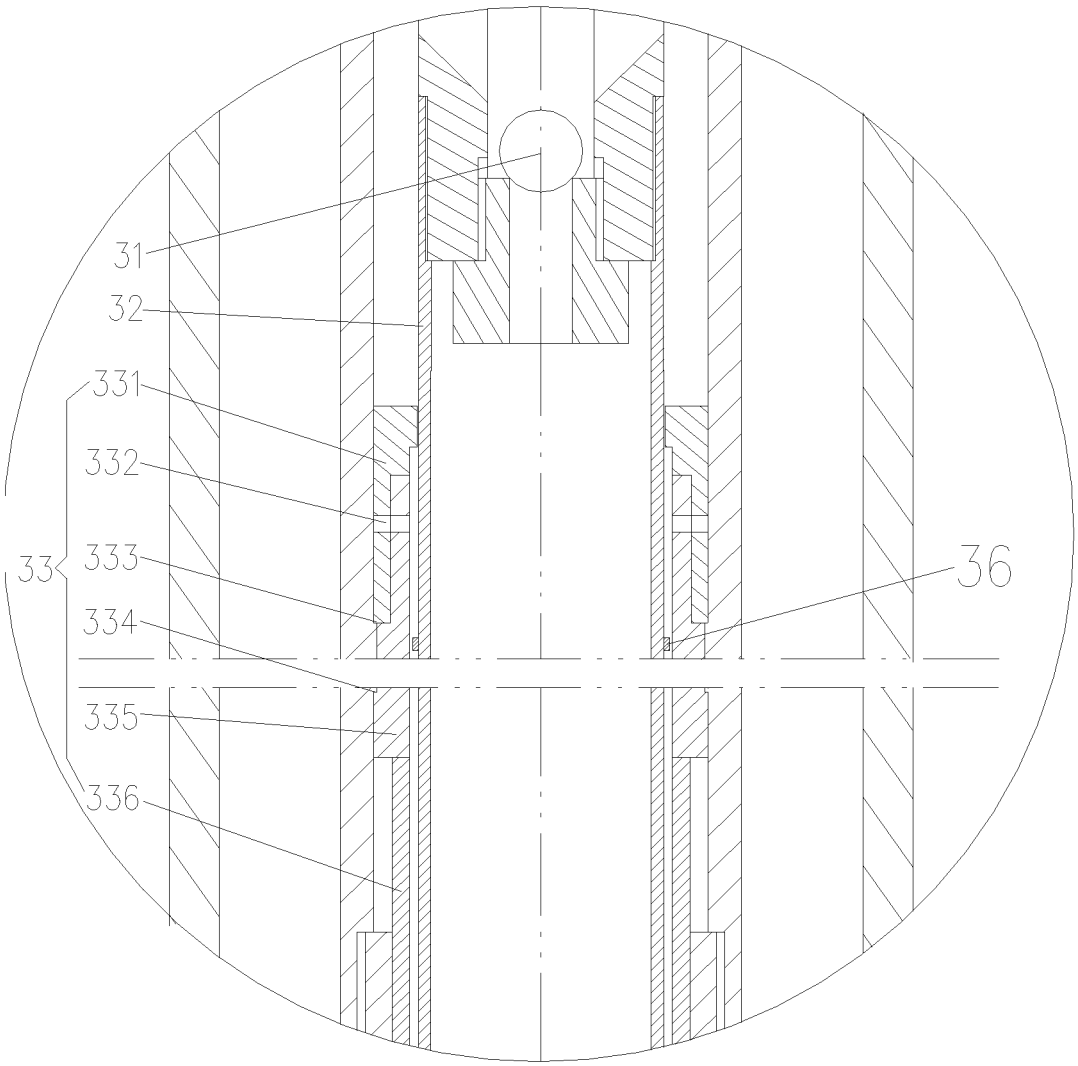
FIG. 5 is an enlarged schematic view of A in FIG. 4.
Figure 6:
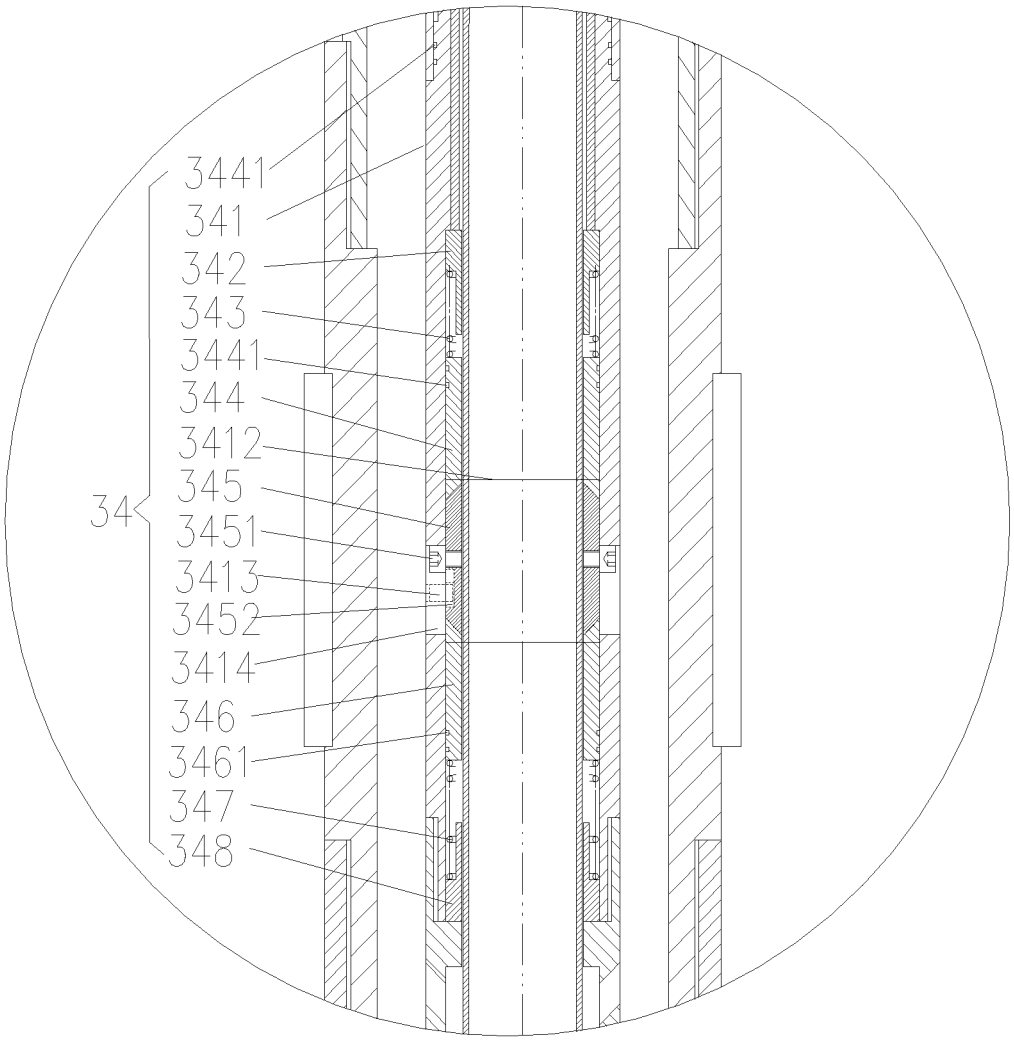
FIG. 6 is an enlarged schematic view of B in FIG. 4.
Figure 7:
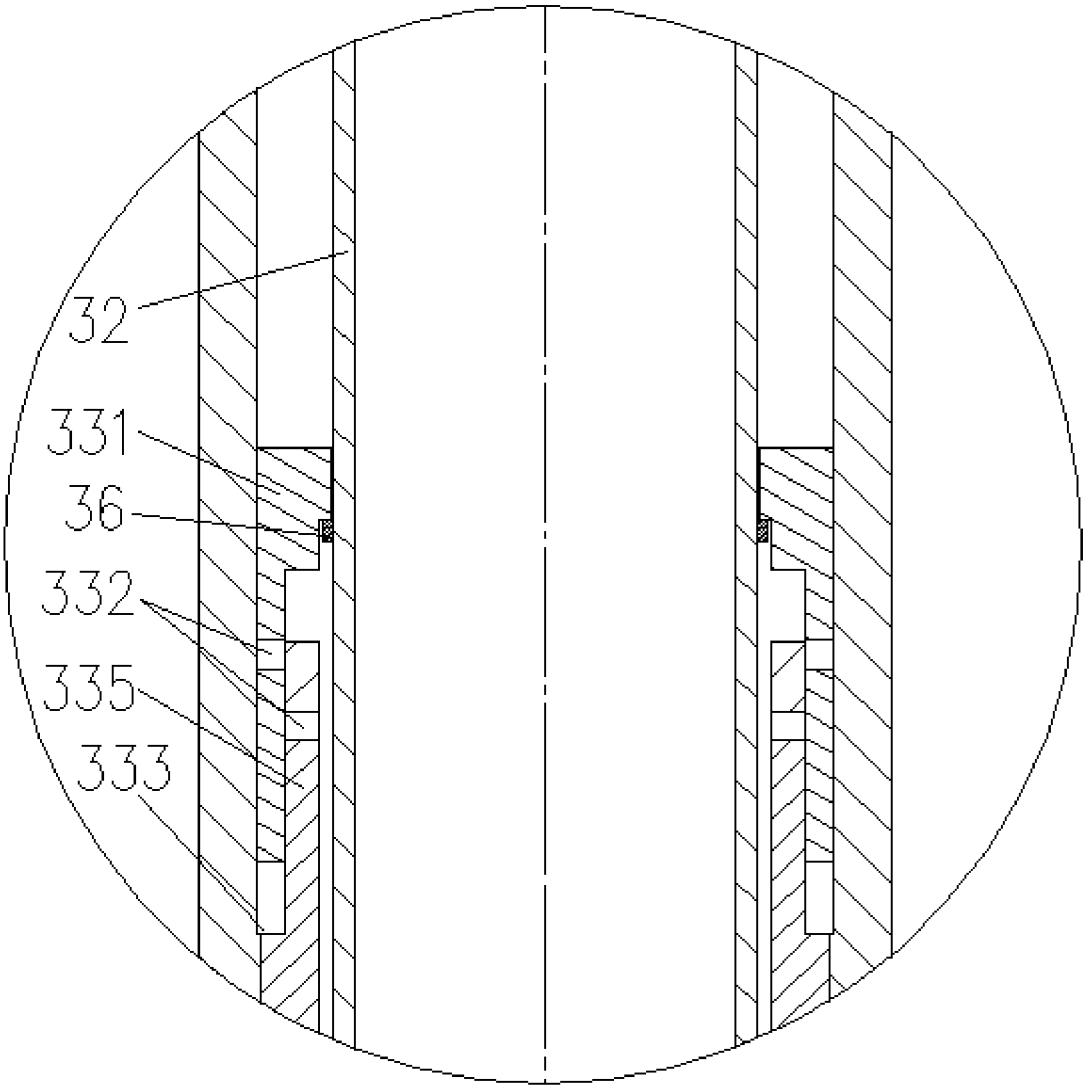
FIG. 7 is a schematic view showing the state of the connection relationship between the shear short section and the counterweight tube after the shear pin is pulled off.
Figure 8:
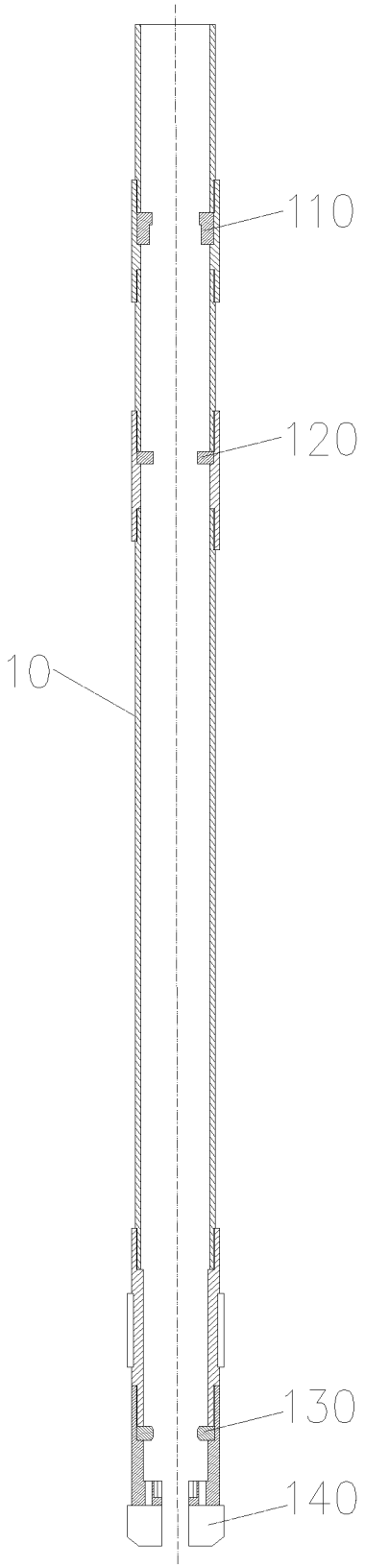
FIG. 8 is a schematic structural view of an outer tube assembly.
Figure 9:
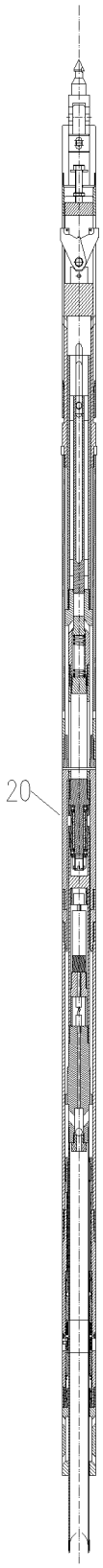
FIG. 9 is a schematic structural view of an inner tube assembly.
Figure 10:
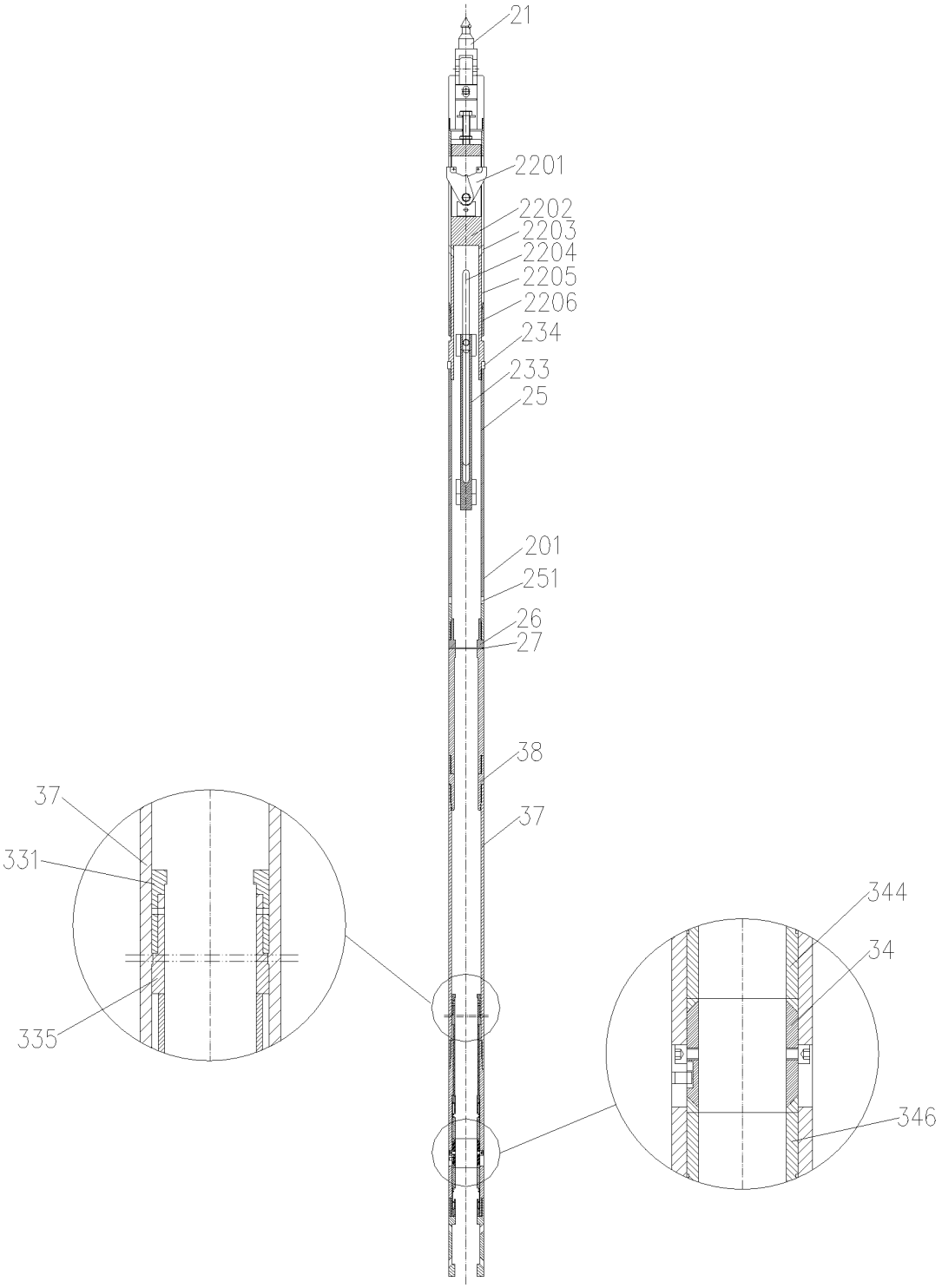
FIG. 10 is a schematic structural view of a first inner tube assembly.
Figure 11:
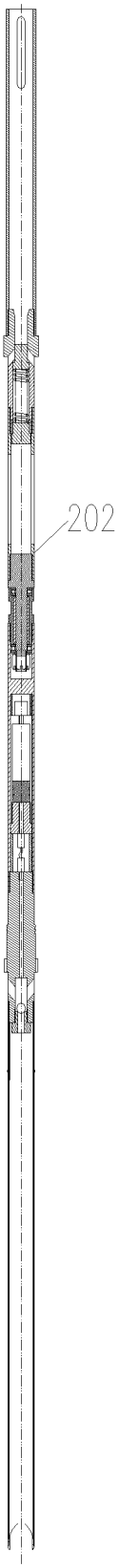
FIG. 11 is a schematic structural view of a second inner tube assembly.

In the figure, 10—outer tube assembly, 20—inner tube assembly, 201—first inner tube assembly, 202—second inner tube assembly, 110—latch chamber, 120—landing ring, 130—inner-tube stabilizer, 140—coring bit, 21—spearhead, 22—latching device, 2201—latch, 2202—latch releasing tube, 2203—latch bracket tube, 2204—inlet, 2205—latch bracket tube long pin hole, 2206—latch releasing tube inclined portion, 23—piston compensation balance mechanism, 231—piston sliding tube, 2311—piston sliding tube long pin hole, 232—spirol pin, 233—suspension plug, 2331—suspension plug inlet, 2332—suspension plug long pin hole, 2233—suspension plug outlet, 2334—suspension plug body, 234—suspension ring, 235—piston body, 2351—piston body inlet passage, 2352—piston body separation passage, 2353—spring chamber, 236—sliding valve, 237—spring, 238—spring base, 24—hydraulic piston rod, 241—hydraulic piston rod long pin hole, 25—hydraulic piston cylinder, 251—hydraulic piston cylinder outlet, 26—piston lower limit short section, 27—limit copper pin, 28—single-action mechanism, 281—upper thrust bearing, 282—mandrel, 283—copper sleeve, 284—bearing sleeve, 285—lower thrust bearing, 286—lock nut, 29—accumulator mechanism, 291—accumulator valve cover, 292—accumulator chamber, 293—piston, 294—accumulator lower end cap, 295—accumulator pressure joint, 296—high pressure hose, 297—high pressure chamber pressure measuring joint, 30—sealing mechanism, 301—sealing joint, 302—pressure passage, 303—sealing joint sealing ring, 304—sealing joint step, 31—ball non-return valve, 32—core barrel, 33—weight tube drive mechanism, 331—shear short section, 332—shear pin, 333—weight tube upper limit shoulder, 334—weight tube lower limit shoulder, 335—counterweight tube, 336—thrust thin-walled tube, 34—pressure-retaining ball valve closing sealing mechanism, 341—ball valve sub, 3411—ball valve sub sealing ring, 3412—ball valve sub window, 3413—ball valve closing drive pin, 3414—ball valve sub oblong hole, 342—ball valve sub upper gland, 343—buffer spring, 344—upper ball valve seat, 3441—upper ball valve seat sealing ring, 345—ball valve, 3451—ball valve shaft, 3452—ball valve closing sliding groove, 346—lower ball valve seat, 3461—lower ball valve seat sealing ring, 347—load-bearing spring, 348—ball valve sub lower gland, 35—penetration cutter, 36—core barrel shoulder, 37—middle tube, 38—sealing head, 39—connecting tube.

DETAILED DESCRIPTION

Hereinafter, the present invention will be further described in conjunction with the drawings and specific embodiments:

As shown in FIGS. 1 to 17, a natural gas hydrate retaining corer includes an outer tube assembly 10 and an inner tube assembly 20 mounted inside the outer tube assembly 10. The inner wall of the outer tube assembly 10 is provided with a landing ring 120 and a latch chamber 110. The bottom end of the outer tube assembly 10 is provided with a coring bit 140.

The inner tube assembly 20 includes a first inner tube assembly 201 and a second inner tube assembly 202 that is mounted inside the first inner tube assembly 201 and axially movable along the first inner tube assembly 201. The first inner tube assembly 201 includes a spearhead 21, a latching device 22, a suspension plug 233, a hydraulic piston cylinder 25, a piston lower limit short section 26, a limit copper pin 27, a sealing head 38, a middle tube 37, a weight tube drive mechanism 33 and a pressure-retaining ball valve closing sealing mechanism 34 connected sequentially from top to bottom. The second inner tube assembly 202 includes a piston compensation balance mechanism 23, a single-action mechanism 28, an accumulator mechanism 29, a sealing mechanism 30 and a core barrel 32 connected sequentially from top to bottom.

The spearhead 21, the latching device 22, the hydraulic piston cylinder 25, the piston lower limit short section 26, the sealing head 38, the middle tube 37, and the ball valve sub 341 on the pressure-retaining ball valve closing sealing mechanism 34 all adopt a threaded connection or an integral structure. The piston compensation balance mechanism 23, the single-action mechanism 28, the accumulator mechanism 29, the sealing mechanism 30 and the core barrel 32 all adopt a threaded connection or an integral structure.

The outer wall of the core barrel 32 is in contact with the inner wall of the inner-tube stabilizer 130, preferably in sealing contact, and the drilling fluid cannot pass through.

The latching device 22 includes a latch 2201, a latch releasing tube 2202, a latch bracket tube 2203, an inlet 2204, a latch bracket tube long pin hole 2205, and a latch releasing tube inclined portion 2206. The latch 2201 is disposed in the latch chamber 110 and is connected to the latch bracket tube 2203. The latch bracket tube 2203 is disposed inside the latch releasing tube 2202. The latch releasing tube 2202 is fixedly connected to the spearhead 21. The bottom end of the latch releasing tube 2202 is provided with the latch releasing tube inclined portion 2206 for latch releasing the latch 2201 from the latch chamber 110. The inlet 2204 is provided on the side wall of the latch releasing tube 2202. The latch tube long pin hole 2205 is disposed inside the middle cavity of the latch bracket tube 2203.

The piston compensation balance mechanism 23 includes a piston sliding tube 231, a suspension ring 234, a piston body 235, a hydraulic piston rod 24, a sliding valve 236, a spring 237 and a spring base 238.

The suspension plug 233 includes a suspension plug inlet 2331 and a suspension plug outlet 2333 disposed on the opposite sides of the suspension plug 233, a suspension plug long pin hole 2332 disposed in the middle cavity of the suspension plug 233, and a suspension plug body 2334 disposed at the bottom end of the suspension plug 233. The suspension plug inlet 2331 and the suspension plug outlet 2333 communicate with each other.

The upper portion of the piston sliding tube 231 is disposed inside the latch bracket tube 2203 and is axially movable along the latch bracket tube 2203, and the lower portion is disposed inside the hydraulic piston cylinder 25. The top end of the piston sliding tube 231 is located below the top end of the latch bracket tube long pin hole 2205.

The piston body 235 is disposed inside the hydraulic piston cylinder 25 and is axially movable relative to the hydraulic piston cylinder 25. The piston body 235 includes a piston body inlet passage 2351, a piston body separation passage 2352, and a spring chamber 2353. The upper and lower ends of the spring chamber 2353 are respectively provided with the sliding valve 236 and the spring base 238. The spring base 238 is fixedly disposed at the lower portion of the piston body 235. The spring chamber 2353 is internally provided with the spring 237. The spring 237 is mounted on the spring base 238. The upper end of the spring 237 is connected to the lower end of the sliding valve 236. The sliding valve 236 protrudes into the piston body inlet passage 2351 by the spring 237, blocking the communication between the piston body inlet passage 2351 and the piston body separation passage 2352. When the drilling fluid enters the piston body inlet passage 2351 and forms a pressure, the sliding valve 236 is pushed to move downward, so that the piston body inlet passage 2351 communicates with the piston body separation passage 2352 again. The arrangement of the sliding valve 236 and the spring 237 increases the pressure required for the drilling fluid to push the piston body 235 to move downward.

The elastic pin 232 disposed in the first inner tube assembly 201 is fixedly disposed on the latch releasing tube 2202 after passing through the latch bracket tube long hole 2205, the piston sliding tube long pin hole 2311 provided in the piston sliding tube 231, and the suspension plug long pin hole 2332. The elastic pin 232 is freely slidable in the latch bracket tube long pin hole 2205, the piston sliding tube long pin hole 2311 and the suspension plug long pin hole 2332, so as to realize a sleeve connection between the latch bracket tube 2203, the suspension plug 233, the piston sliding tube 231 and the latch releasing tube 2202, thereby achieving connection between the piston compensation balancing mechanism 23 and the latching device 22.

The latch releasing tube 2202 drives the suspension plug 233 to move up and down by the elastic pin 232. When the suspension plug body 2334 protrudes into the piston body inlet passage 2351, the communication between the suspension plug outlet 2333 and the piston body inlet passage 2351 is blocked, further blocking the water passage between the suspension plug 233 and the piston body 235. At this time, the drilling fluid forms a high pressure above the piston body 235, the piston body 235 is pushed to move axially downward along the hydraulic piston cylinder 25, so that the suspension plug body 2334 is disengaged from the piston body inlet passage 2351 and the suspension plug outlet 2333 is in communication with the piston body inlet passage 2351. When the drilling fluid further forms a high pressure, the sliding valve 236 is pushed downward to compress the spring 237, so that the sliding valve 236 is disengaged from the piston body inlet passage 2351, and the piston body inlet passage 2351 communicates with the piston body separation passage 2352. Thus, the suspension plug inlet 2331, the suspension plug outlet 2333, the piston body inlet passage 2351, and the piston body separation passage 2352 communicate with each other to form a water passage.

The lower end of the piston body 235 is connected to the upper end of the hydraulic piston rod 24 located inside the hydraulic piston cylinder 25, and the upper end of the piston body 235 is connected to the lower end of the piston sliding tube 231, which can be both screwed connection. The hydraulic piston rod 24 is provided with the hydraulic piston rod long pin hole 241. The upper and lower ends of the hydraulic piston rod long pin hole 241 are both solid structures. The lower end of the hydraulic piston cylinder 25 is connected to the upper end of the piston lower limit short section 26. The lower portion of the hydraulic piston cylinder 25 is provided with the hydraulic piston cylinder outlet 251. The hydraulic piston cylinder outlet 251 is located above the piston lower limit short section 26. The hydraulic piston cylinder outlet 251 communicates with the piston body separation passage 2352. The upper end of the hydraulic piston cylinder 25 is connected to the lower end of the latch bracket tube 2203 to realize the connection between the hydraulic piston cylinder 25 and the latching device 22. The connection between the hydraulic piston cylinder 25 and the latch bracket tube 2203 is provided with the suspension ring 234. The suspension ring 234 is seated on the landing ring 120. The inner tube assembly 20 is mounted inside the outer tube assembly 10 in a suspending manner by the suspension ring 234.

The limit copper pin 27 is disposed on the piston lower limit short section 26. The limit copper pin 27 is fixedly disposed on the piston lower limit short section 26 after passing through the hydraulic piston rod long pin hole 241 on the hydraulic piston rod 24 and the piston lower limit short section 26. The piston lower limit short section 26 can support the self-weight of the inner tube assembly 20 in the upper area of the hydraulic piston rod 24 through the limit copper pin 27.

Since the hydraulic piston rod long pin hole 241 has an axial long through hole, the limit copper pin 27 does not limit the axial movement of the hydraulic piston rod 24. When the hydraulic piston rod 24 reaches the down limit position, the limit copper pin 27 is not in contact with the solid portion of the upper end of the hydraulic piston rod 24. When the limit copper pin 27 is in contact with the solid portion of the lower end of the hydraulic piston rod 24 and when the hydraulic piston rod 24 is moved further upward, the limit copper pin 27 is pulled off.

The single-action mechanism 28 includes an upper thrust bearing 281, a mandrel 282, a copper sleeve 283, a bearing sleeve 284, a lower thrust bearing 285 and a lock nut 286.

The upper end of the mandrel 282 is screwed to the bottom end of the hydraulic piston rod 24. The bearing sleeve 284 is sleeved on the mandrel 282. The copper sleeve 283 is disposed between the bearing sleeve 284 and the mandrel 282. The upper and lower ends of the copper sleeve 283 are respectively provided with the upper thrust bearing 281 and the lower thrust bearing 285. The bottom end of the mandrel 282 is provided with the lock nut 286. The lower thrust bearing 285 is located above the lock nut 286.

The single-action mechanism 28 is located inside the piston lower limit short section 26. The single-action mechanism 28 is connected to the connecting tube 39 via the copper sleeve 283. The connecting tube 39 is connected to the accumulator mechanism 29, thereby realizing the connection between the single-action mechanism 28 and the accumulator mechanism 29. The lower end of the piston lower limit short section 26 is connected to the upper end of the sealing head 38. The lower end of the sealing head 38 is connected to the upper end of the middle tube 37 located inside the outer tube assembly 10. The connection between the sealing head 38 and the middle tube 37 is provided with a sealing head sealing ring (not shown). The single-action mechanism 28 prevents the core barrel 32 from rotating along with the outer tube assembly 10 to cause core wear, and simultaneously transmits the thrust of the piston body 235. The core barrel 32 is pressed against the hole bottom, and the core barrel 32 is only pressed down and does not rotate.

The accumulator mechanism 29 includes an accumulator valve cover 291, an accumulator chamber 292, a piston 293, an accumulator lower end cap 294, an accumulator pressure joint 295, a high pressure hose 296, and a high pressure chamber pressure measuring joint 297 disposed sequentially from top to bottom. The accumulator chamber 292 is used for storing nitrogen gas. The piston 293 is located inside the accumulator chamber 292 and is axially movable along the accumulator chamber 292. The joint between the piston 293 and the accumulator chamber 292 is provided with a sealing ring. The piston 293 is in contact with the accumulator lower end cap 294. An axial through hole is formed in the middle portion of the accumulator lower end cover 294. The accumulator pressure joint 295 is connected to the high pressure chamber pressure measuring joint 297 through the high pressure hose 296. The axial through hole, the accumulator pressure joint 295 and the high pressure hose 296 communicate with the high pressure chamber pressure measuring joint 297 to form an air passage. The accumulator mechanism 29 is located inside the connecting tube 39.

The sealing mechanism 30 includes a sealing joint 301, a pressure passage 302, a sealing joint sealing ring 303 and a sealing joint step 304. The upper end of the sealing joint 301 is connected to the lower end of the connecting tube 39, and is connected to the accumulator mechanism 29. The middle portion of the sealing joint 301 is provided with the axial pressure passage 302. The lower end of the high pressure chamber pressure measuring joint 297 protrudes into the pressure passage 302 and communicates with the pressure passage 302. The sealing joint 301 is sleeved with the sealing joint sealing ring 303. The sealing joint 301 is provided on both sides with the sealing joint step 304.

The sealing mechanism 30 is located inside the middle tube 37 and is axially movable along the middle tube 37. When the sealing joint step 304 is in contact with the sealing head 38, the sealing mechanism 30 stops moving upward.

The one-way ball valve 31 is connected below the sealing mechanism 30, so that the airflow can only flow from bottom to top through the one-way ball valve 31 to the pressure passage 302 of the sealing mechanism 30;

The lower end of the one-way ball valve 31 is screwed to the upper end of the core barrel 32. The core barrel 32 is located inside the middle tube 37. The core barrel 32 is provided with the core barrel shoulder 36.

The weight tube drive mechanism 33 includes a shear short section 331, a shear pin 332, a counterweight upper limit shoulder 333, a counterweight lower limit shoulder 334, a counterweight tube 335 and a thrust thin-walled tube 336. The shear short section 331 is located between the middle tube 37 and the core barrel 32. The shear short section 331 is seated on the counterweight tube upper limit shoulder 333 on the inner wall of the middle tube 37. The shear short section 331 is clearance-fitted with the middle tube 37 and the shear short section 331 is clearance-fitted with the core barrel 32 such that the shear short section 331 is in a vertical state. The shear pin 332 passes through the shear short section 331 and the counterweight tube 335 such that the shear short section 331 is connected to the counterweight tube 335. The upper end of the counterweight tube 335 is in contact with the shear short section 331. The lower end of the counterweight tube 335 is fixedly connected to the thrust thin-walled tube 336. The counterweight tube 335 is in contact with the counterweight tube lower limit shoulder 334 on the middle tube 37. The counterweight tube 335 is held by the counterweight tube lower limit shoulder 334 through concave-convex fitting on one side and thus is not able to pass over. The counterweight tube lower limit shoulder 334 is located below the counterweight tube upper shoulder 333. The counterweight tube 335 is located between the middle tube 37 and the core barrel 32. The outer wall of the counterweight tube 335 is clearance-fitted with the inner wall of the middle tube 37. The counterweight tube 335 is not in contact with the core barrel 32. The thrust thin-wall pipe 336 is neither in contact with the middle tube 37 nor the core barrel 32.

The weight tube drive mechanism 33 is located between the middle tube 37 and the core barrel 32. The core barrel shoulder 36 is located between the counterweight tube 335 and the core barrel 32 and underneath the shear short section 331. The shear short section 331 is suspended between the middle tube 37 and the core barrel 32 through the counterweight tube upper limit shoulder 333 such that the counterweight tube 335 connected to the shear short section 331 and the thrust thin-walled tube 336 are also suspended between the middle tube 37 and the core barrel 32.

In the specific use, the middle tube 37 does not slide upward under the reaction force of the latching device 22. The core barrel 32 slides upward to drive the core barrel shoulder 36 to move upward and contact the shear short section 331. When the core barrel 32 continues to move upward, since the counterweight tube 335 connected to the shear short section 331 is held by the counterweight tube lower limit shoulder 334 on the middle tube 37 and cannot move, the shear pin 332 between the counterweight tube 335 and the shear short section 331 is pulled off by the thrust of the core barrel 32 which pushes the shear short section 331 to move upward. The counterweight tube 335 is disconnected from the shear short section 331. The counterweight tube 335 slides downward under the action of gravity.

Figure 13:
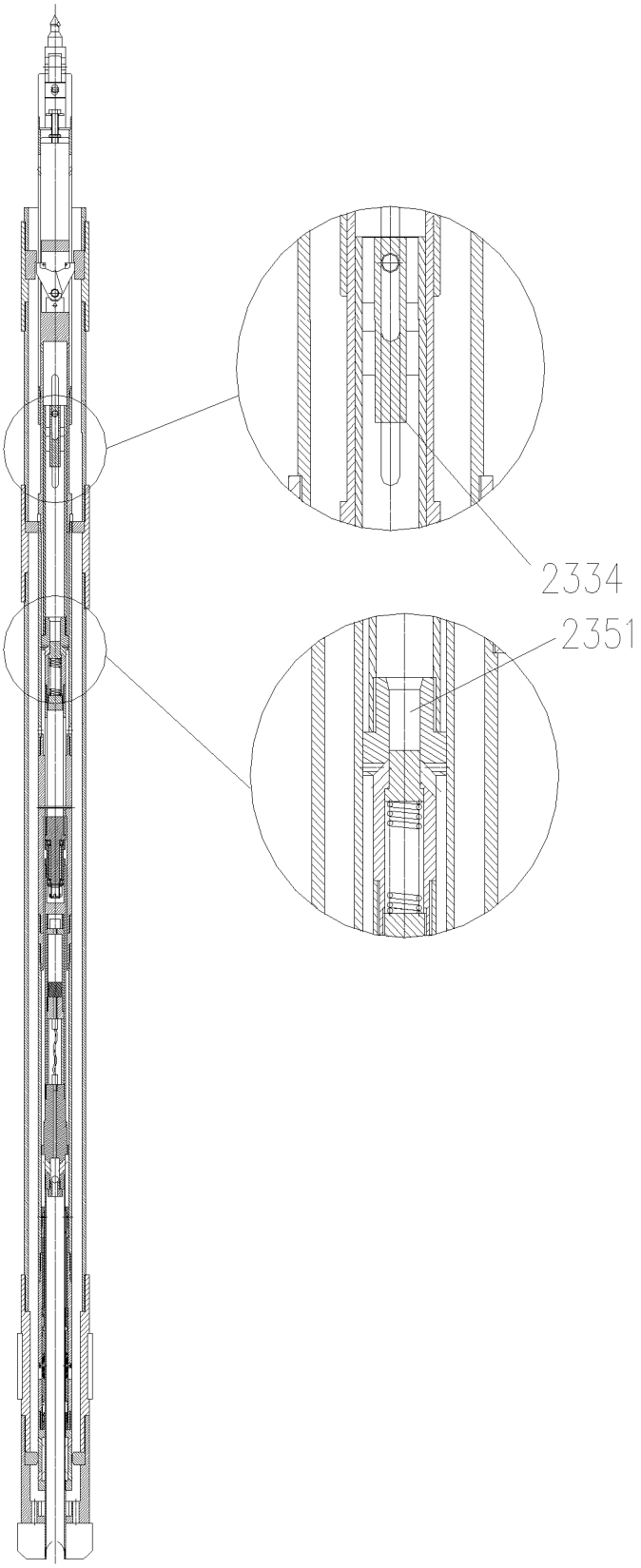
FIG. 13 is one of the schematic diagrams of the state during the process of retrieving by wireline and latch releasing (the suspension plug body is away from the piston body inlet passage)

After the drilling fluid enters from the inlet 2204, a downward thrust is generated in the piston compensation balance mechanism 23 through the hydraulic piston cylinder 25, so that the piston body 235 moves downward. The suspension plug 233 is fixedly hung on the elastic pin 232 and remains stationary. The suspension plug body 2334 is disengaged from the piston body inlet passage 2351. As shown in FIG. 13, the suspension plug body 2334 is disengaged from the piston body inlet passage 2351, and the piston body inlet passage 2351 communicates with the inlet 2204 to form a water passage. When the piston body 235 reaches the down limit position, the spring base 238 connected to the piston body 235 does not contact the limit copper pin 27, and the sliding valve 236 still protrudes into the piston body inlet passage 2351. The piston body inlet passage 2351 is not in communication with the piston body separation passage 2352. The drilling fluid continues to form a high pressure above the piston body 235. The drilling fluid starts to push the sliding valve 236 to move downward. The sliding valve 236 is disengaged from the piston body inlet passage 2351. The piston body inlet passage 235 communicates with the piston body separation passage 2352, so that the inlet 2204 communicates with the hydraulic piston cylinder outlet 251 to form a water passage.

Figure 12:
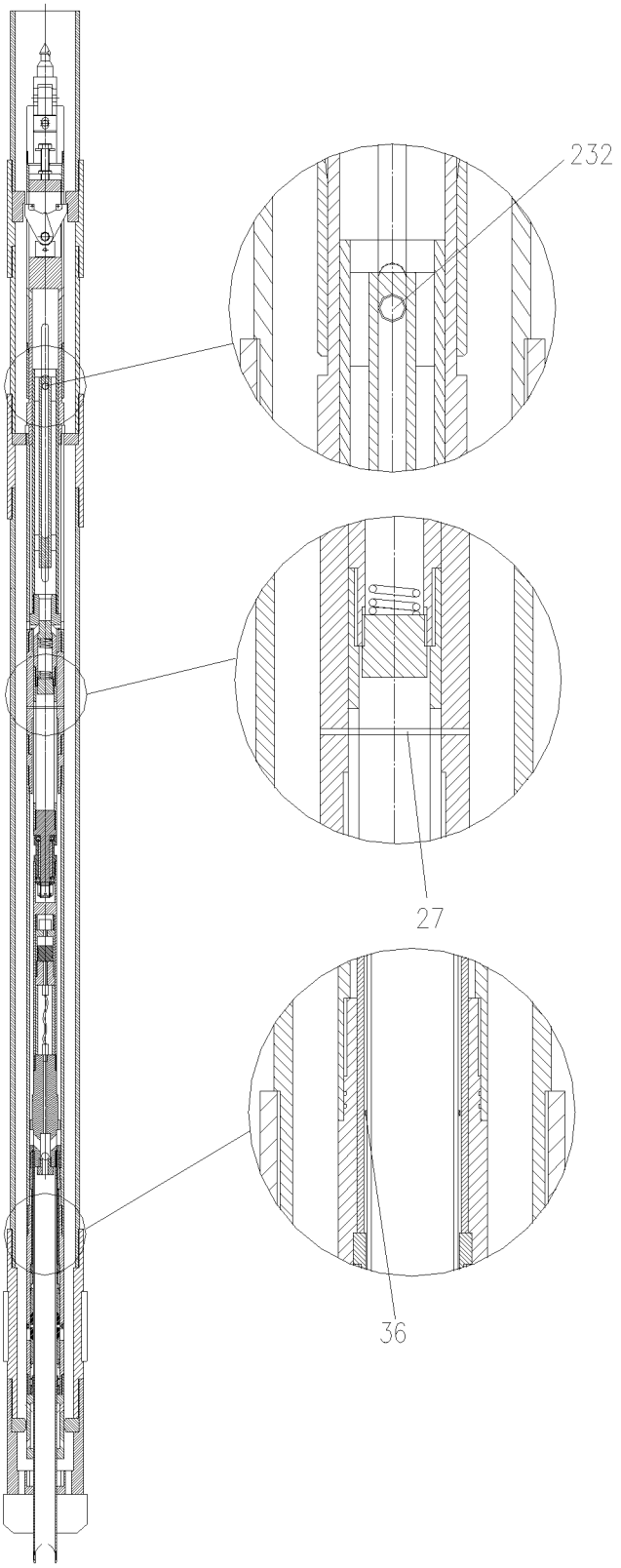
FIG. 12 is one of the schematic diagrams of the state during the drilling and coring process (the second inner tube assembly is moved down)

When the drilling fluid generates a downward thrust to the piston compensation balance mechanism 23, during the downward movement of the piston body 235, the piston body 235 pushes the core barrel 32 to move downward sequentially through the single-action mechanism 28, the accumulator mechanism 29 and the sealing mechanism 30. The penetration cutter 35 in front of the core barrel 32 is micro-penetrated into the formation at the hole bottom at a small depth. As shown in FIG. 12, the penetration cutter 35 protrudes from the outer tube assembly 10 into the formation, and the resistance encountered when the core barrel 32 and the cutter penetrate the formation is balanced with the downward thrust of the piston body 235. When the coring bit 140 is swung into the ruler and cleans the formation around the penetration depth of the penetration cutter 35, the balance is broken. The penetration cutter 35 follows the coring bit 140 to enter the ruler and squeeze and trim the core into the core barrel 32 to form a dynamic balance. The position of the piston body 235 in the hydraulic piston cylinder 25 is the position of the piston body 235 when the thrust of the piston body 235 is balanced with the resistance encountered when the core barrel 32 and the cutter penetrate the formation. When the outer tube assembly 10 rises with the wave, the piston body 235 sinks relative to the hydraulic piston cylinder 25. The drilling fluid enters the hydraulic piston cylinder 25 to generate a downward thrust to the piston body 235, so that the core barrel 32 and the cutter are kept pressed against the hole bottom and do not follow the rising and sinking of the outer tube assembly 10, avoiding the core barrel 32 from moving up and down along with the outer tube assembly 10 to cause the problem of core grinding and core blocking, which improves the core success rate and reduces the disturbance to the core.

The pressure-retaining ball valve closing sealing mechanism 34 includes a ball valve sub 341, a ball valve upper gland 342, a buffer spring 343, an upper ball valve seat 344, a ball valve 345, a lower ball valve seat 346, a load-bearing spring 347, and a ball valve lower gland 348. The ball valve 345 is provided with a ball valve shaft 3451 and a ball valve closing sliding groove 3452. The ball valve 345 is provided with a through hole for the core barrel 32 to pass through.

The ball valve sub 341 on the first inner tube assembly 201 is provided with a ball valve sub sealing ring 3411, a ball valve closing drive pin 3413 and a ball valve sub oblong hole 3414 sequentially from top to bottom.

The upper end of the ball valve sub 341 is connected to the lower end of the middle tube 37. The connection between the ball valve sub 341 and the middle tube 37 is provided with the ball valve sub sealing ring 3411. The hollow interior of the ball valve sub 341 is provided with a ball valve sub window 3412. The middle portion of the ball valve sub 341 is provided with the ball valve sub oblong hole 3414. The ball valve closing drive pin 3413 located in the ball valve sub oblong hole 3414 is fixed on the inner wall of the ball valve sub 341. The ball valve closing drive pin 3413 protrudes into the ball valve closing sliding groove 3452 on the ball valve 345.

The ball valve 345 is fixedly disposed in the ball valve sub window 3412 of the ball valve sub 341 through the ball valve shaft 3451. One end of the ball valve shaft 3451 is connected to the ball valve 345, and the other end protrudes into the ball valve sub oblong hole 3414, and can freely slide axially along the ball valve sub long hole 3414.

The ball valve sub 341 is provided internally with the upper ball valve seat 344 and the lower ball valve seat 346. The attachment between the ball valve sub 341 and the upper ball valve seat 344 is provided with an upper ball valve seat sealing ring 3441. The attachment between the ball valve sub 341 and the lower ball valve seat 346 is provided with a lower ball valve seat sealing ring 3461. The upper ball valve seat 344 is provided with the buffer spring 343 and the ball valve sub upper gland 342 sequentially from bottom to top. The upper and lower ends of the buffer spring 343 are respectively connected to the ball valve upper gland 342 and the upper ball valve seat 344. The upper end of the ball valve sub upper gland 342 is connected to the lower end of the thrust thin-walled tube 336. The lower end of the upper ball valve seat 344 is in contact with the ball valve 345. The lower ball valve seat 346 is provided with the load-bearing spring 347 and the ball valve sub lower gland 348 sequentially from top to bottom. The upper and lower ends of the load-bearing spring 347 are respectively connected to the lower ball valve seat 346 and the ball valve lower gland 348. The upper end of the lower ball valve seat 346 is in contact with the ball valve 345.

The floating contact of the ball valve 345 with the upper ball valve seat 344 and the lower ball valve seat 346 is achieved by the buffer spring 343 and the load-bearing spring 347.

The connection between the upper end of the ball valve sub 341 and the lower end of the middle tube 37 and the connection between the upper end of the ball valve sub upper gland 342 and the lower end of the thrust thin-walled tube 336 realize the connection between the pressure-retaining ball valve closing sealing mechanism 34 and the weight tube drive mechanism 33 and the middle tube 37. The weight tube drive mechanism 33 can push the ball valve 345 of the pressure-retaining ball valve closing sealing mechanism 34 to flip 90°.

Figure 16:
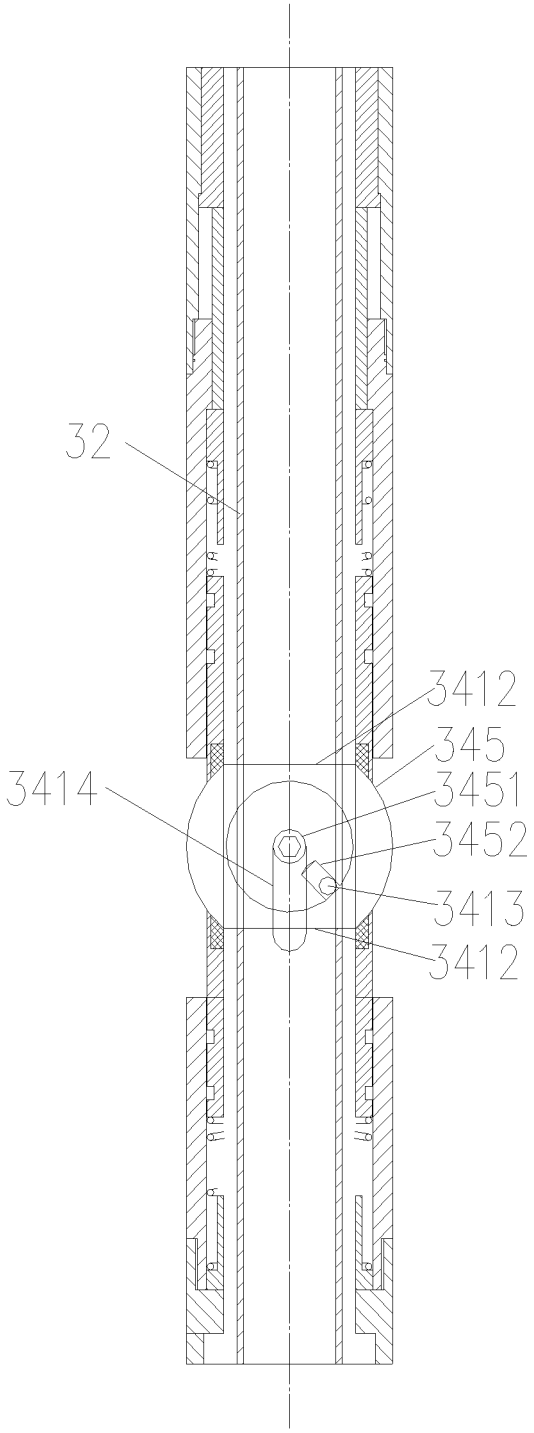
FIG. 16 is one of the schematic diagrams of the state of the ball valve during the process of flipping (the core barrel is not pulled out of the ball valve through hole)
Figure 17:
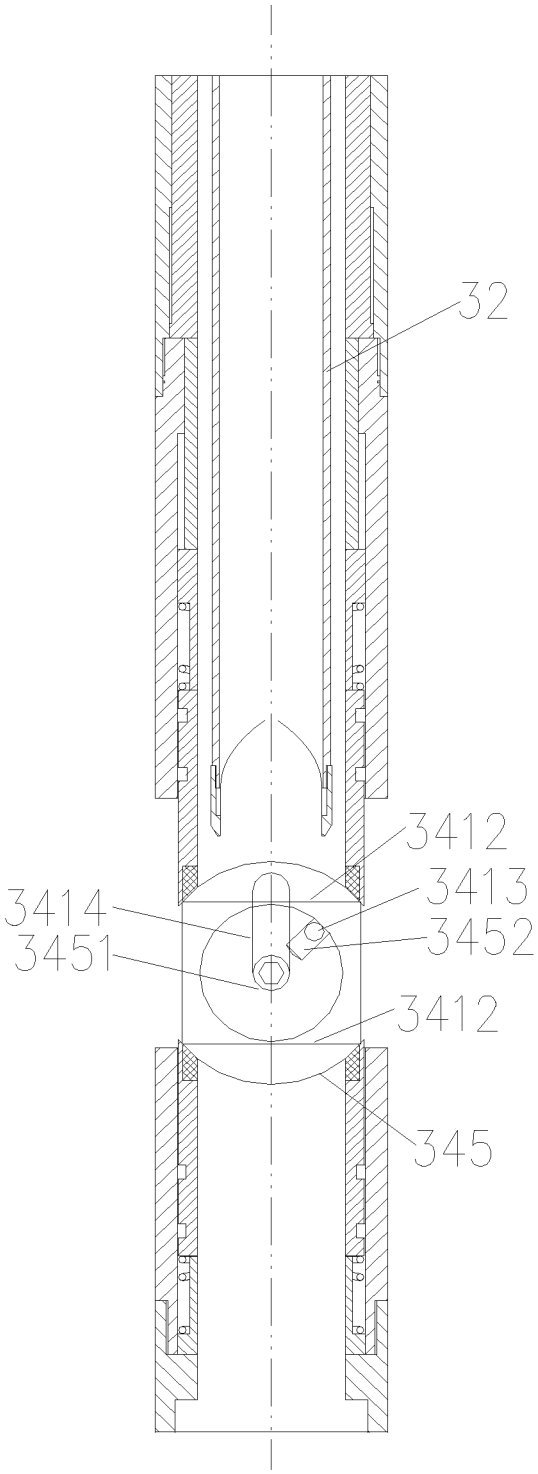
FIG. 17 is one of the schematic diagrams of the state during the process of flipping the ball valve (the core barrel has been pulled out from the ball valve through hole)

In specific use, as shown in FIG. 16 and FIG. 17, after the core barrel 32 is pulled upward from the through hole of the ball valve 345, the counterweight tube 335 of the weight tube drive mechanism 33 slides downward by gravity to push the ball valve 345 to move down as a whole along the ball valve sub long hole 3414. When the ball valve shaft 3451 connected to the ball valve 345 is in contact with the ball valve closing drive pin 3413, the thrust generated by the counterweight tube 335 being pushed down pushes the ball valve closing drive pin 3413. Because the ball valve closing drive pin 3413 is held by the ball valve closing sliding groove 3452 on the ball valve 345, the ball valve closing drive pin 3413 gives a torque to the ball valve 345, which realizes that the ball valve 345 slides downward and flips by 90°. The ball valve 345 is in sealing contact with the upper ball valve seat 344, realizing the pressure retaining effect of the upper portion of the ball valve 345. At this time, the core barrel 32 is located in the pressure-retaining area above the ball valve 345, so that the coring sample in the core barrel 32 is in a pressure retaining state, realizing the pressure-retaining sampling of the corer.

Further, the lower end of the pressure-retaining ball valve closing sealing mechanism 34 is connected to a flushing mechanism for flushing the core barrel 32. The flushing mechanism is installed on the first inner tube assembly 201. The flushing mechanism avoids debris such as cuttings on the core barrel 32 being brought into the corer, especially brought into the pressure-retaining area, which affects the pressure retaining effect, and may even fail to retain pressure.

The flushing mechanism includes a flushing mechanism inlet and a flushing mechanism outlet. After the high pressure drilling fluid enters from the inlet, the cuttings on the core barrel 32 are rapidly flushed at a high pressure. The drilling fluid is subsequently discharged from the outlet. The flushing mechanism is screwed to the lower end of the ball valve sub 341 and connected to the lower end of the ball valve lower gland 348.

In this embodiment, after the drilling fluid flows out of the hydraulic piston cylinder outlet 251, it flows into the area between the middle tube 37 and the outer tube assembly 10. Because the inner-tube stabilizer 130 is disposed between the inner wall of the outer tube and the flushing mechanism, and the inner-tube stabilizer 130 is in sealing contact with the flushing mechanism, the drilling fluid in the area between the middle tube 37 and the outer tube assembly 10 cannot pass between the inner-tube stabilizer 130 and the flushing mechanism, and the drilling fluid can only flow from the flushing mechanism inlet to realize the drilling liquid flushing the core barrel 32 by the flushing mechanism.

In this embodiment, the coring bit 140 is located below the flushing mechanism and the coring bit 140 is a five-wing carbide scraper bit 140.

Figure 14:
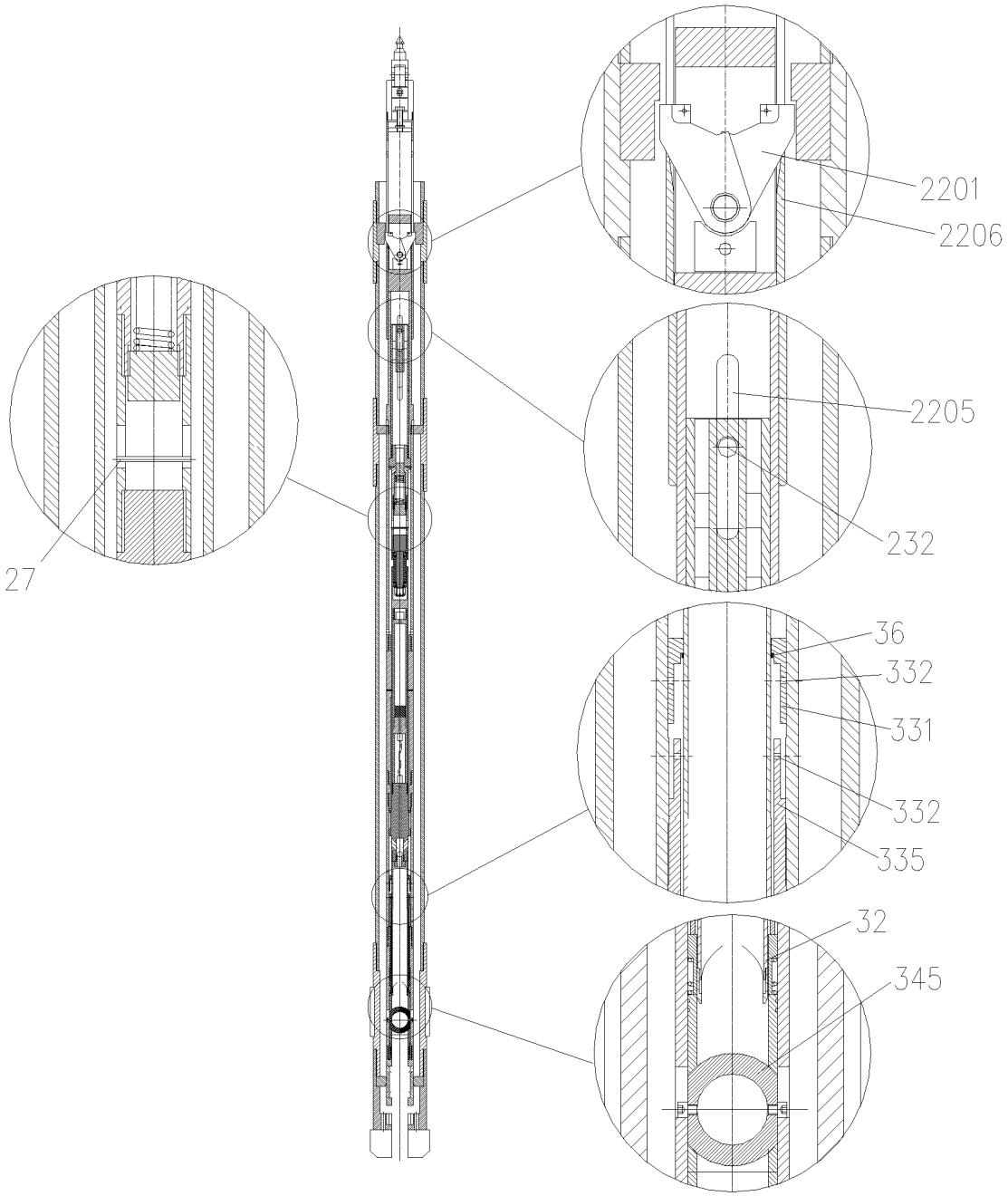
FIG. 14 is one of the schematic diagrams of the state during the process of retrieving by wireline and latch releasing (the ball valve is flipped by 90°)
Figure 15:
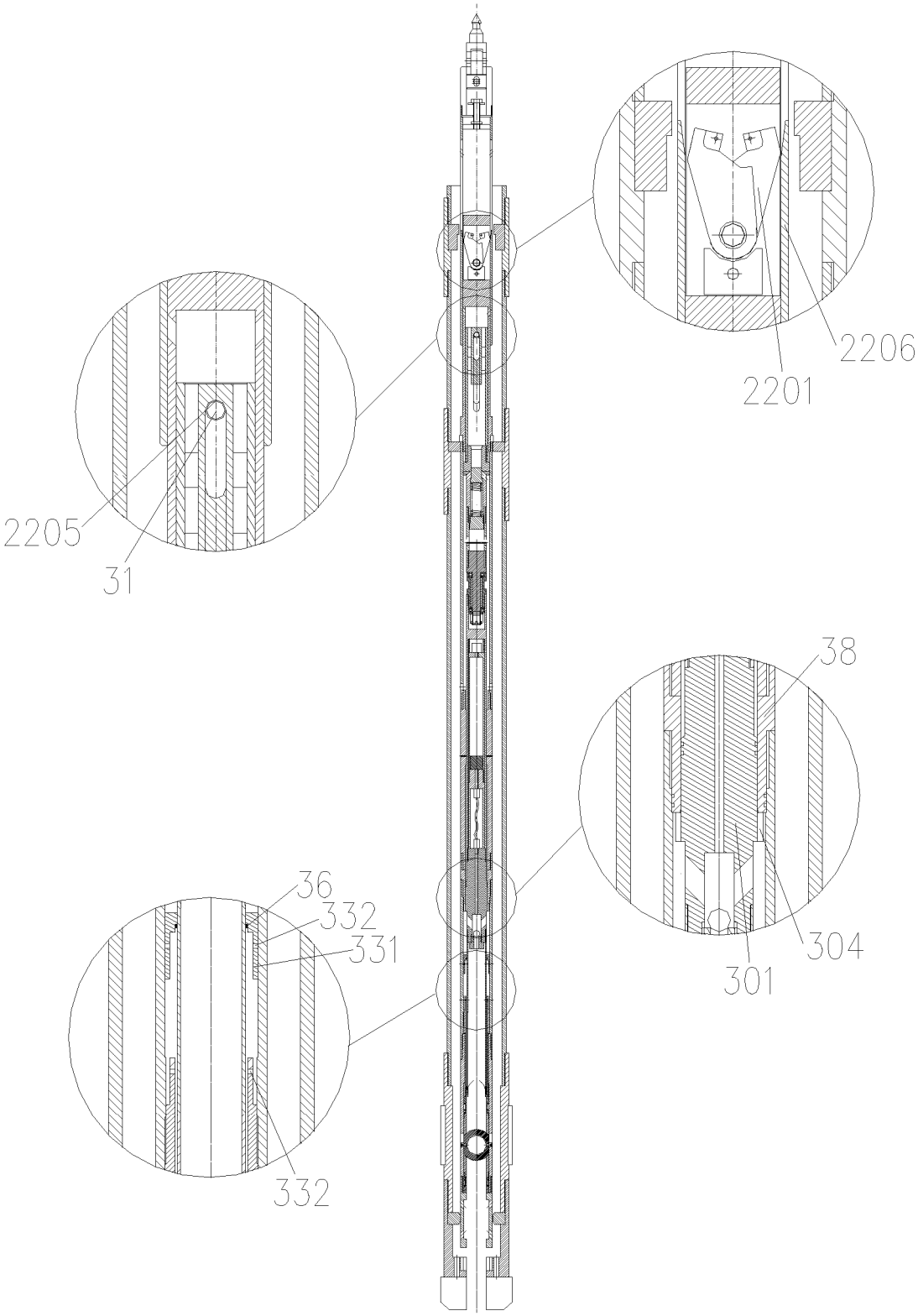
FIG. 15 is one of the schematic diagrams of the state during the process of retrieving by wireline and latch releasing (the latch releasing action is completed)

As shown in FIGS. 13 to 15, in the specific use, when the piston body 235 pushes the core barrel 32 to move downward so that the core enters the core barrel 32, the retrieving by wireline and coring process begins. The spearhead 21 drives the latch releasing tube 2202 and the elastic pin 232 on the latch releasing tube 2202 to move upward. The latch releasing tube inclined portion 2206 on the latch releasing tube 2202 is in contact with the latch 2201, so that the latch 2201 is disconnected from the latch chamber 110, completing the latch releasing action. The elastic pin 232 drives the suspension plug 233 to move upward along the piston sliding tube long pin hole 2311 until the elastic pin 232 ascends to contact the upper end of the piston sliding tube long pin hole 2311. Before the elastic pin 232 is in contact with the upper end of the piston sliding tube long pin hole 2311, the elastic pin 232 moves upward along the latch bracket tube long pin hole 2205 together with the piston sliding tube 231 and the suspension plug 232. During the upward movement of the piston sliding tube 231 by the elastic pin 232, the piston body 235 connected to the piston sliding tube 231 also moves upward. The piston body 235 drives the hydraulic piston rod 24 to move upward. The limit copper pin 27 is in contact with the lower end of the hydraulic piston rod 24 and is then pulled off by the hydraulic piston rod 24. The hydraulic piston rod 24 sequentially drives the single-action mechanism 28, the connecting tube 39, the accumulator mechanism 29, the sealing mechanism 30, the one-way ball valve 31 and the core barrel 32 to move upward together until the elastic pin 232 ascends to contact the upper end of the latch bracket tube long pin hole 2205 and all of the above stop moving. At this time, the sealing joint step 304 is in contact with the sealing head 38. Before the sealing joint step 304 is in contact with the sealing head 38, the latch releasing tube inclined portion 2206 on the latch releasing tube 2202 is in contact with the latch 2201 first. The latch 2201 is disconnected from the latch room 110 to complete the latch releasing action.

During the upward movement of the core barrel 32, the core barrel 32 is pulled out from the through hole of the ball valve 345. When the core barrel 32 is pulled up to the upper portion of the through hole of the ball valve 345, the core barrel 32 triggers the counterweight tube 335 on the weight tube drive mechanism 33 to drive the ball valve 345 to slide downward and flip 90°.

The process by which the core barrel 32 triggers the counterweight tube 335 on the weight tube drive mechanism 33 to drive the ball valve 345 to slide downward is achieved as follows. The core barrel shoulder 36 on the core barrel 32 starts contact the shear short section 331 during the upward movement of the core barrel 32. At this time, the core barrel 32 has been pulled up to the upper portion of the through hole of the ball valve 345, and the sealing joint step 304 has not been in contact with the sealing head 38. As the core barrel 32 continues to move upward, the core barrel shoulder 36 pulls the shear short section 331 to move upward. The shear pin 332 between the shear short section 331 and the counterweight tube 335 is pulled off. The counterweight tube 335 slides downward under the action of gravity, so that the weight tube drive mechanism 33 pushes down the ball valve 345 of the pressure-retaining ball valve closing sealing mechanism 34 to slide down and flip 90°. The ball valve 345 is in sealing contact with the upper ball valve seat 344.

The area between the upper portion of the ball valve 345 that is in contact with the upper ball valve seat 344 and the lower portion of the sealing joint step 304 that is in contact with the sealing head 38 is a stable pressure-retaining area. The core barrel 32 containing the core sample is located in the pressure-retaining area, which ensures that the core is in the pressure-retaining area and the core is in a pressure-retaining state under high pressure, realizing the pressure-retaining coring.

After the elastic pin 232 ascends to contact the upper end of the latch bracket long pin hole 2205, the latch releasing tube inclined portion 2206 is in contact with the latch 2201 and disconnects the latch 2201 from the latch chamber 110, thereby completing the latch releasing action. The latch releasing tube 2202 continues to move upward so that the entire inner tube assembly 20 can be pulled out of the outer tube assembly 10, thereby taking the core sample of the inner tube assembly 20 and completing the entire process of coring.

In actual use, during the retrieving by wireline and upward movement of the inner tube assembly 20, the surrounding confining pressure of the present invention is gradually reduced until the atmospheric pressure environment of the wellhead. Within a certain time range, there may be micro leakage in the pressure-retaining area, and the pressure-retaining area starts to release pressure to the outside. When the pressure drops to a certain extent, the natural gas hydrate decomposes. In order to avoid this problem, in this embodiment, the accumulator mechanism 29 is provided. When micro leakage occurs, the pressure at the hole bottom is greater than the nitrogen setting pressure of the accumulator chamber 292 of the accumulator mechanism 29 in the deep sea hole bottom. The piston 293 compresses the nitrogen of the accumulator chamber 292 upward and accumulates. After the inner tube assembly 20 completes the coring, the retrieving by wireline is moved up to the wellhead, and the confining pressure is gradually reduced to the normal atmospheric pressure. When leakage occurs in the pressure-retaining area of the inner tube assembly 20, the nitrogen energy of the accumulator mechanism 29 is released. The piston 293 is pushed downward to inject the liquid into the pressure-retaining area, so that the pressure-retaining area is still in a pressure-retaining state under high pressure, and thus even in the case of microleakage, the pressure is kept stable and the core is prevented from being decomposed.

Various other changes and modifications may be made by those skilled in the art in light of the above-described technical solutions and concepts, and all such changes and modifications are intended to fall within the scope of the appended claims.

What is claimed is:

1. A natural gas hydrate pressure-retaining corer, comprising: an outer tube assembly and an inner tube assembly mounted inside the outer tube assembly, the inner wall of the outer tube assembly being provided with a landing ring and a latch chamber, and a coring bit being provided at the bottom end of the outer tube assembly, wherein the inner tube assembly includes a first inner tube assembly and a second inner tube assembly, the second inner tube assembly is mounted inside the first inner tube assembly and is axially movable along the first inner tube assembly, the first inner tube assembly includes a spearhead, a latching device, a suspension plug, a hydraulic piston cylinder, a piston lower limit short section, a limit copper pin, a sealing head, a middle tube, a weight tube drive mechanism and a pressure-retaining ball valve closing sealing mechanism connected sequentially from top to bottom; and the second inner tube assembly comprises a piston compensation balance mechanism, a single-action mechanism, an accumulator mechanism, a sealing mechanism and a core barrel connected sequentially from top to bottom;

the piston compensation balance mechanism includes a piston sliding tube, a piston body and a hydraulic piston rod;

the suspension plug includes a suspension plug inlet and a suspension plug outlet disposed on opposite sides of the suspension plug, and the suspension plug inlet and the suspension plug outlet communicate with each other;

the upper portion of the piston sliding tube is disposed inside the latching device and is axially movable along the latching device, and a lower portion of the piston sliding tube is disposed inside the hydraulic piston cylinder;

the piston body is disposed inside the hydraulic piston cylinder and is axially movable relative to the hydraulic piston cylinder, the piston body includes a piston body inlet passage and a piston body separation passage; the lower end of the piston body is connected to the upper end of the hydraulic piston rod located inside the hydraulic piston cylinder, the upper end of the piston body is connected to the lower end of the piston sliding tube; the bottom end of the hydraulic piston cylinder is connected to the upper end of piston lower limit short section, a lower portion of the hydraulic piston cylinder is provided with an outlet of the hydraulic piston cylinder, and the outlet of the hydraulic piston cylinder and the piston body separation passage communicate with each other; and a suspension ring is arranged at the connection between the hydraulic piston cylinder and the latching device, and the suspension ring is seated on the landing ring;

the piston lower limit short section is provided with a limit copper pin, and the limit copper pin is fixedly disposed on the piston lower limit short section after passing through a hydraulic piston rod long pin hole on the hydraulic piston rod and the piston lower limit short section;

the single-action mechanism is located inside the piston lower limit short section, and the single-action mechanism is connected to a connecting tube, the lower end of the piston lower limit short section is connected to the upper end of the sealing head, and the lower end of the sealing head is connected to the upper end of the middle tube located inside the outer tube;

the sealing mechanism is located inside the middle tube and is axially movable along the middle tube;

the core barrel is located inside the middle tube, and the core barrel is provided with a core barrel shoulder;

the weight tube drive mechanism comprises a shear short section, a shear pin, a counterweight tube upper limit shoulder, a counterweight tube lower limit shoulder, a counterweight tube and a thrust thin-walled tube, the shear short section is located between the middle tube and the core barrel, the shear short section is seated on the counterweight tube upper limit shoulder on the inner wall of the middle tube, the shear short section is clearance-fitted with the middle tube and the shear short section is clearance-fitted with the core barrel, and are in a vertical state; the shear pin passes through the shear short section and the counterweight tube, so that the shear short section is connected to the counterweight tube, the upper end of the counterweight tube is in contact with the shear short section, the lower end of the counterweight tube is fixedly connected to the thrust thin-walled tube, and the counterweight tube is in contact with the counterweight tube lower limit shoulder on the middle tube, and the counterweight tube is held by the counterweight tube lower limit shoulder and cannot pass over;

the pressure-retaining ball valve closing sealing mechanism comprises a ball valve sub, a ball valve sub upper gland, an upper ball valve seat, a ball valve, a lower ball valve seat and a ball valve sub lower gland; the ball valve sub is provided with a ball valve closing drive pin and a ball valve sub oblong hole and a ball valve sub window disposed inside the hollow portion of the ball valve sub sequentially from top to bottom; the ball valve is provided with a ball valve shaft and a ball valve closing sliding groove, and the ball valve is provided with a through hole for the core barrel to pass through;

the upper end of the ball valve sub is connected to the lower end of the middle tube, the middle portion of the ball valve sub is provided with the ball valve sub oblong hole, the ball valve closing drive pin located in the ball valve sub oblong hole is fixed on the inner wall of the ball valve sub, and the ball valve closing drive pin protrudes into the ball valve closing sliding groove on the ball valve;

the ball valve is fixedly disposed in the ball valve sub window of the ball valve sub through the ball valve shaft, the ball valve shaft is connected to the ball valve at one end, and the other end of the ball valve shaft protrudes into the ball valve sub oblong hole, and is axially slidable freely in the ball valve sub oblong hole;

the interior of the ball valve sub is provided with the upper ball valve seat and the lower ball valve seat, the upper ball valve seat is connected to the ball valve sub upper gland, the upper end of the ball valve sub upper gland is connected to the lower end of the thrust thin-walled tube, the lower end of the upper ball valve seat is in contact with the ball valve, the lower ball valve seat is connected to the ball valve sub lower gland, and the upper end of the lower ball valve seat is in contact with the ball valve;

the lower end of the pressure-retaining ball valve closing sealing mechanism is connected to a flushing mechanism for flushing the core barrel; and the pressure-retaining ball valve closing sealing mechanism is connected to the weight tube drive mechanism and the middle tube, and the weight tube drive mechanism can push the ball valve of the pressure-retaining ball valve closing sealing mechanism to flip by 90°.

2. The natural gas hydrate pressure-retaining corer according to claim 1, wherein the single-action mechanism comprises an upper thrust bearing, a mandrel, a copper sleeve, a bearing sleeve, a lower thrust bearing and a lock nut, the upper end of the mandrel is screwed to the bottom end of the hydraulic piston rod, the bearing sleeve is sleeved on the mandrel, the copper sleeve is arranged between the bearing sleeve and the mandrel, the upper and lower ends of the copper sleeve are respectively provided with the upper thrust bearing and the lower thrust bearing, the bottom end of the mandrel is provided with the lock nut, and the lower thrust bearing is located above the lock nut.

3. The natural gas hydrate pressure-retaining corer according to claim 1, wherein the lower end of the pressure-retaining ball valve closing sealing mechanism is connected to the flushing mechanism for flushing the core barrel.

4. The natural gas hydrate pressure-retaining corer according to claim 1, wherein the piston body further comprises a spring chamber, the spring chamber has a sliding valve and a spring base respectively on the upper and lower ends, the spring base is fixedly disposed at a lower portion of the piston body, a spring is disposed inside the spring chamber, the spring is mounted on the spring base, and the upper end of the spring is connected to the lower end of the sliding valve.

5. The natural gas hydrate pressure-retaining corer according to claim 1, wherein the inner tube assembly is provided with an accumulator mechanism, and the accumulator mechanism is located between the single-action mechanism and the sealing mechanism and connected to the single-action mechanism and the sealing mechanism respectively.

6. The natural gas hydrate pressure-retaining corer according to claim 5, wherein the accumulator mechanism comprises an accumulator valve cover, an accumulator chamber, a piston, and an accumulator lower end cap, an accumulator pressure joint, a high pressure hose and a high pressure chamber pressure measuring joint arranged sequentially from top to bottom, the piston is located inside the accumulator chamber and is axially movable along the accumulator chamber, a sealing ring is arranged at the junction of the piston and the accumulator chamber, the piston is in contact with the accumulator lower end cover, an axial through hole is arranged in the middle portion of the accumulator lower end cover, the accumulator pressure joint is connected to the high pressure chamber pressure measuring joint through the high pressure hose, the axial through hole, the accumulator pressure joint, the high pressure hose and the high pressure chamber pressure measuring joint communicate with each other to form an air passage, and the accumulator mechanism is located inside the connecting tube.

7. The natural gas hydrate pressure-retaining corer according to claim 1, wherein the sealing mechanism comprises a sealing joint, a pressure passage, a sealing joint sealing ring and a sealing joint step, the upper end of the sealing joint is connected to the lower end of the connecting tube and is connected to the accumulator mechanism, the middle portion of the sealing joint is provided with the axial pressure passage, the lower end of the high pressure chamber pressure measuring joint protrudes into the pressure passage and communicates with the pressure passage, the sealing joint is sleeved with the sealing joint sealing ring, and the sealing joint is provided with sealing joint steps on each side.

8. The natural gas hydrate pressure-retaining corer according to claim 1, wherein the attachment between the ball valve sub and the upper ball valve seat is provided with an upper ball valve seat sealing ring, the attachment between the ball valve sub and the lower ball valve seat is provided with a lower ball valve seat sealing ring; the upper ball valve seat is provided with a buffer spring, the upper and lower ends of the buffer spring are respectively connected to the ball valve upper gland and the upper ball valve seat, the upper end of the ball valve sub upper gland is connected to the lower end of the thrust thin-walled tube, the lower end of the upper ball valve seat is in contact with the ball valve; the lower ball valve seat is provided with a load-bearing spring, the upper and lower ends of the load-bearing spring are respectively connected to the lower ball valve seat and the ball valve sub lower gland, and the upper end of the lower ball valve seat is in contact with the ball valve.

9. The natural gas hydrate pressure-retaining corer according to claim 1, wherein the ball valve is in floating contact with the upper ball valve seat, and the ball valve is in floating contact with the lower ball valve seat.

10. The natural gas hydrate pressure-retaining corer according to claim 1, wherein the counterweight tube lower limit shoulder is located below the counterweight tube upper limit shoulder, the counterweight tube is located between the middle tube and the core barrel, the outer wall of the counterweight tube is clearance fitted with the inner wall of the middle tube, a clearance is provided between the counterweight tube and the core barrel, a clearance is provided between the thrust thin-walled tube and the middle tube and between the thrust thin-walled tube and the core barrel, the core barrel shoulder is located between the counterweight tube and the core barrel and is located below the shear short section, and the shear short section is suspended between the middle tube and the core barrel through the counterweight tube upper limit shoulder, so that the counterweight tube and the thrust thin-walled tube connected to the shear short section are also suspended between the middle tube and the core barrel.

* * * * *